US006729057B1

(12) United States Patent
Lu

(10) Patent No.: US 6,729,057 B1
(45) Date of Patent: May 4, 2004

(54) HANDY ENCASEMENT

(75) Inventor: Tai-Wan Lu, Shulin (TW)

(73) Assignee: Safe Fire Protection Equipment, Taipei Hsien (TW)

( * ) Notice: Subject to any disclaimer, the term of this patent is extended or adjusted under 35 U.S.C. 154(b) by 48 days.

(21) Appl. No.: 10/271,738

(22) Filed: Oct. 17, 2002

(51) Int. Cl.[7] ..... G09F 1/00

(52) U.S. Cl. ..... 40/611.02; 40/611.11; 40/793

(58) Field of Search ..... 40/606.16, 606.17, 40/606.18, 611.01, 611.02, 611.05, 611.11, 723, 779, 781, 782, 570, 574, 793, 795, 796

(56) References Cited

U.S. PATENT DOCUMENTS 3,310,901 A * 3/1967 Sarkisian ..... 40/793
4,519,152 A * 5/1985 Seely et al. ..... 40/791
4,702,025 A * 10/1987 Mace ..... 40/793
4,756,107 A * 7/1988 Hillstrom ..... 40/603
5,077,924 A * 1/1992 Yamaguchi ..... 40/603
5,265,362 A * 11/1993 Yamaguchi ..... 40/603
5,307,575 A * 5/1994 Ivansson et al. ..... 40/793
5,608,980 A * 3/1997 Pangerl ..... 40/793

* cited by examiner

*Primary Examiner*—Mark T. Le
(74) *Attorney, Agent, or Firm*—Rosenberg, Klein & Lee

(57) ABSTRACT

A handy encasement for sign or advertisement board is essentially sustained with a couple of transverse skeletons and a couple of longitudinal skeletons. The transverse or longitudinal skeletons are equipped with a base and an upper lid combined together so as to encircle an accommodation space. A spring bow is intercalated between the base and the upper lid of the transverse skeletons such that the upper lid can keep a proper open angle with the base by its one side remains articulated with the base thereby facilitating replacement of inner components of the encasement. Jointing four mating portions between the bases and the upper lids with four corner junctions and patch members configurates a handy encasement without the need of any tools. A rectangular slot formed along inner edges of the encasement makes it possible to glaze a surface board on each surface for signs or advertisements.

10 Claims, 6 Drawing Sheets

HANDY ENCASEMENT

BACKGROUND OF THE INVENTION

1. Field of the Invention

The present invention relates to a handy encasement, and more particularly, to an encasement which can be assembled and detached without using any tools to put into or take out the contents. Signs such as an emergency exit or other commercial advertisements may be displayed on its surface board for public services.

2. Description of the Prior Art

Conventionally, the sign of emergency exit or various commercial advertisements are made on the surface board of an rectangular parallelepiped encasement along whose transverse framework a lamp and a battery unit are set for lighting purpose.

Normally, the encasement is assembled using a plurality of screws to tie up the adjacent frameworks. Such an assembly way causes inconveniency for the replacement of the components inside the encasement because those screws must be untied one by one to detach the encasement.

In view of this, it is what the reason the inventor of the present invention has endeavored for years by continuous reseach and experimentation trying to find out the remedy to rectify the inherent shortcomings of the conventional techniques described above, and at last has succeeded in realizing the present invention.

SUMMARY OF THE INVENTION

Accordingly, it is the main object of the present invention to provide a handy encasement for a sign board capable of assembling and detaching by free hand without using any tools so as to facilitate installation or replacement of components inside the encasement.

To achieve the aforesaid objects, the handy encasement of the present invention is sustained with a couple of transverse skeletons and a couple of longitudinal skeletons. The transverse or longitudinal skeletons are equipped with a base and an upper lid combined together so as to encircle an accommodation spacing with the above mentioned four skeletons. A spring bow is intercalated between the base and the upper lid of the transverse skeletons such that the upper lid can keep a proper open angle with the base by its one side remains articulated with the base thereby facilitating replacement of inner components of the encasement. Jointing four mating portions between the bases and the upper lids with four corner junctions and patch members configurates a handy encasement without using any tools. A rectangular slot formed along inner edges of the encasement makes it possible to glaze a surface board on each surface for advertisements.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
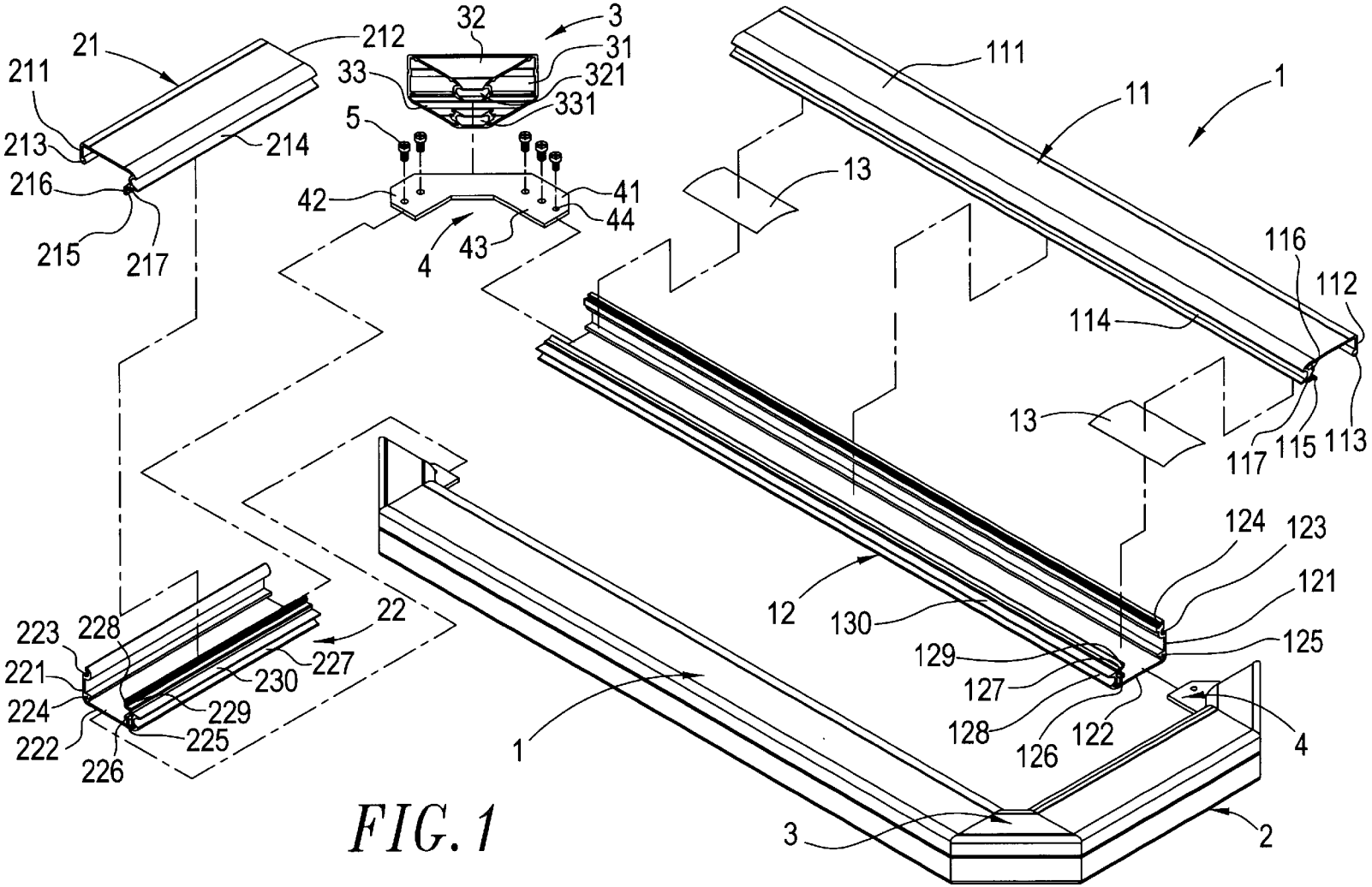
FIG. 1 is a fragmentary exploded view of the handy encasement according to the present invention.
Figure 2:
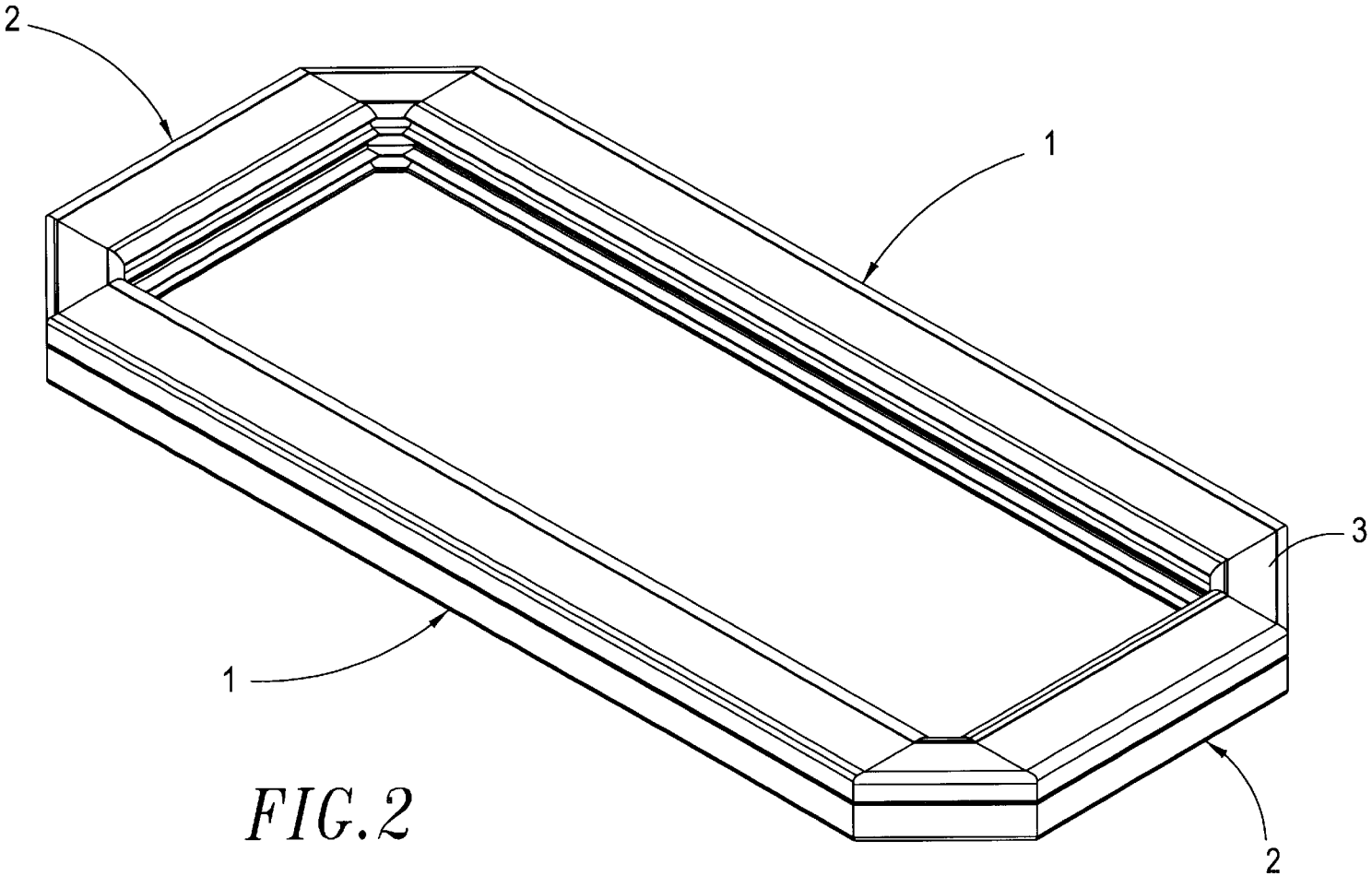
FIG. 2 is a three dimensional view of the handy encasement according to the present invention.
Figure 3:
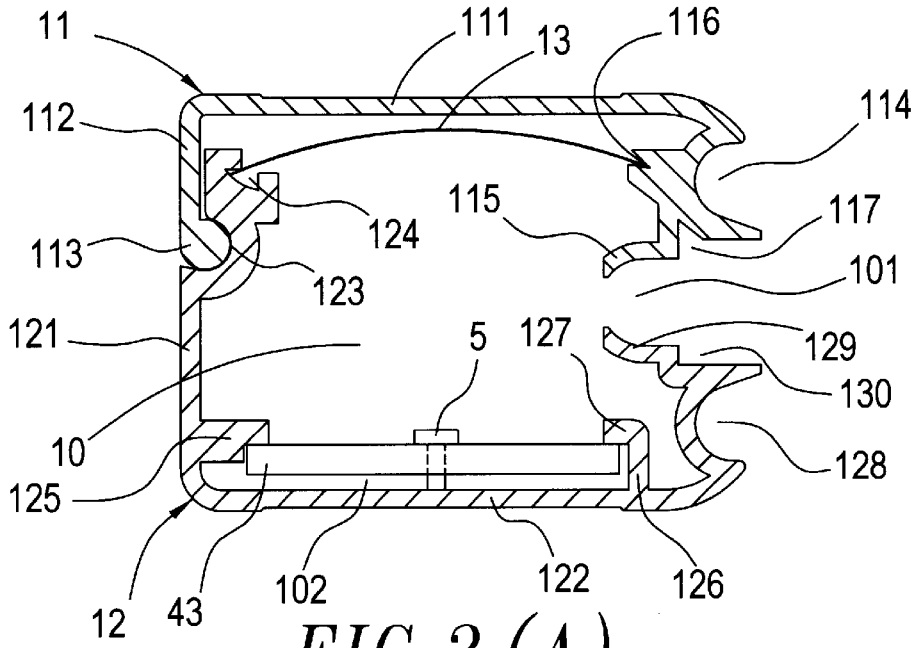
FIGS. 3A and 3B are cross sectional views of the transverse skeleton of the handy encasement according to the present invention.
Figure 3:
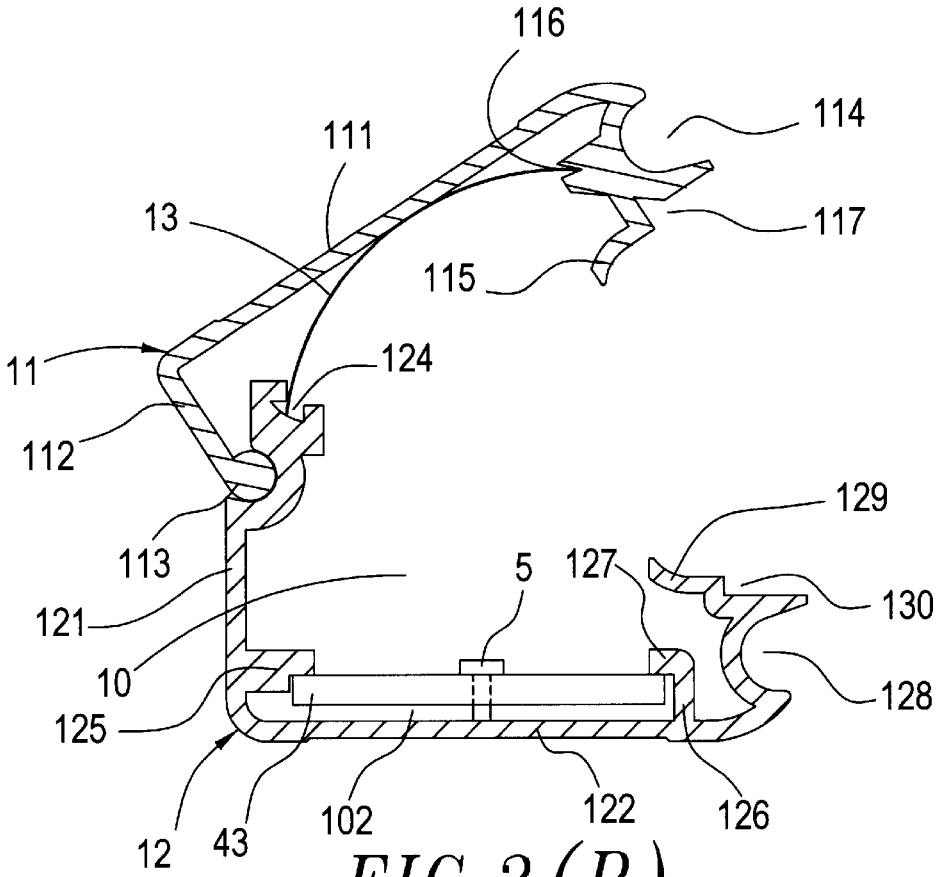
Figure 4:
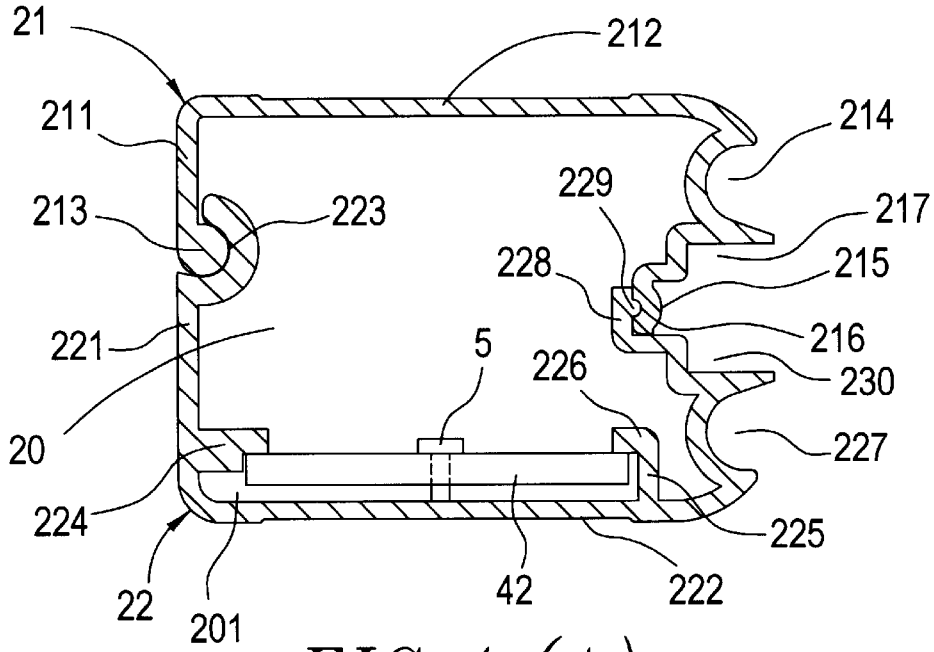
FIGS. 4A and 4B are cross sectional views of the longitudinal skeleton of the handy encasement according to the present invention.
Figure 4:
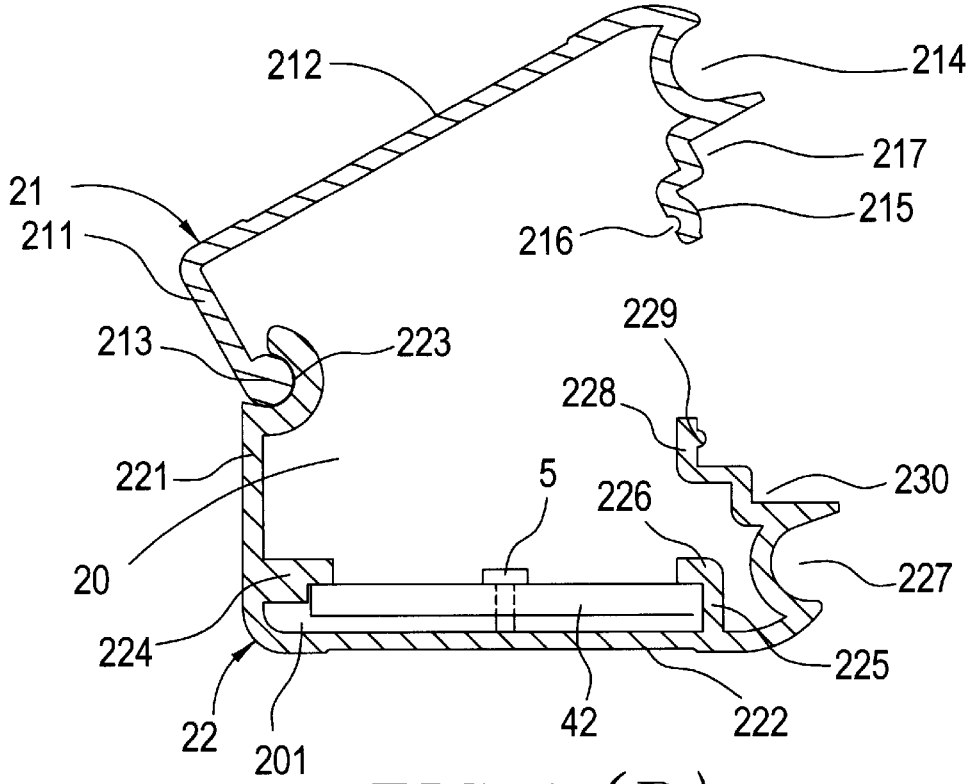

Referring to FIG. 1 through FIGS. 4A, 4B, a handy encasement of the present invention essentially comprises two transverse skeletons 1, two longitudinal skeletons 2, four corner junctions 53, four patch members 4, and two surface boards 8.

The transverse skeletons 1 further include a base 12 and an upper lid 11, and the base 12 is further composed of a liner palate 121 and a bottom plate 122 perpendicular to each other. The top end of the liner plate 121 is-formed into a guide slot 124 while the portion below the guide slot 124 is curved into an arcuate shape to form a detent slot 123. A stopper stump 125 is extended from the bottom of the liner plate 121, while a standing post 126 with a fixing plate 127 extending parallelly against the stopper stump 125 from its tip so as to form a joint portion 102 thereof. The top portion of the bottom plate 122 is formed into a recess 128 with a pallet 130 on it, and an arcuate plate 129 is further extended inwardly from the pallet 130. The upper lid 11 includes a wall plate 112 and a roof plate 111 perpendicular to each other. The bottom portion of the wall plate 112 is formed into a block 113 while the tip of the roof plate 111 has a recess 114 with a pallet 117 below it. The pallet 117 is further inwardly extended to form an arcuate plate 115. A notch 116 is formed on the tip of the roof plate 111 at the opposite side of the recess 114. When the upper lid 11 is put on the base 12, the block 113 formed at the bottom of the wall plate 112 falls into the detent slot 123 formed on the liner plate 121 so as to form an accommodation space 10 between the roof plate 111 and the bottom plate 122. A spring bow 13 is then laid between the base 12 and the upper lid 11 with its one end slidably set in the guide slot 124 of the liner plate 121, while the other end is inserted into the notch 116 thereby reliably conjoining the upper lid 111 and the base 12 together. When the upper lid 11 is lifted upwards by articulation motion of the block 113 in the detent slot 123 of the liner plate 121, the upper lid 11 is held stationary by the tension of the spring bow 13 and never liverated form the base 12. The arcuate plates 115 and 129 respectively formed at the tips of the upper lid 11 and the base 12 do not come to touch with each other but form an opening 101.

The longitudinal skeletons 2 further include, a base 22 and an upper lid 22, and the base 22 is further composed of a liner plate 221 and a bottom plate 222 perpendicular to each other. The end portion of the liner plate 221 is formed into a detent slot 223. A stopper stump 224 is inwardly extended in horizontal direction from a relevant position below the detent slot 223, and a post 225 is standing inwardly at a proper front portion of the base plate 222 and a fixing plate 226 is extended vertically from the tip of the post 225 parallel to the stopper stump 224 so as to form a joint portion 201. A recess 227 entraining a pallet 230 is provided at the front end of the bottom plate 222, wherein an extension plate 228 with a button 229 is protruded upwardly from the pallet 230. The upper lid 21 further includes a wall plate 211 and a roof plate 212 perpendicular to each other. The end portion of the wall plate 211 is formed into a block 213, while the front tip of the roof plate 212 is formed into a recess 214 with a pallet 217 below it. A hasp 215 with a detent slot 216 is extended from the pallet 217. With this structure the roof plate 212 can be opened by the articulation motion of its block 213 in the detent slot 223(FIG. 4B). When the roof plate 212 is enclosed on the liner plate 221, and the button 29 is clogged in the detent slot 216 (FIG. 4A), a closed space 20 is enseized by the longitudinal skeletons 2.

Four corner junctions 3 (FIGS. 1,2), each has an upper and a lower triangular joint plates 32,33 vertically extended from both ends of the main body 31 thereof. The two corresponding joint plates 32,33 form an accommodation space therebetween. Each joint plate 32(33) has pallet 321 (331) respectively at its own front tip which being respectively corresponding to the above mentioned base pallets 230, 130 and the upper lid pallets 217, 117.

Four patch members 4 each has two flexed end plates 42,43 extended from two sides of the main body 41. Several tapped holes 44 are provided on the end plates 42,43 for fixing with screws 5.

In assembling, firstly, setting the main bodies 41 of the patch members 4 on the lower joint plates 33 of the corner junctions 3 then respectively setting the end plates 42, 43 of the patch members 4 in the aforementioned joint portions 102, 201; tightening the screws 5 in the tapped holes 44 of the patched members 4 so as to secure the patched members 4 to the stopper stumps 125, 224 and the fixing plates 127, 226 thereby engaging the base 12 of the transverse skeletons 1, corner junctions 3, and the base 22 of the longitudinal skeletons 2 tightly together to form a rectangular parallelopiped framework with an accommodation cavity in it. Surface boards 8 can be provided on the front and the rear surfaces of this structure by glazing the board into the slot formed along the inner edges of the structure by those pallets 130,230, 117, 217 respectively formed by the bases 12, 22, upper lids 11, 21 of the transverse and longitudinal skeletons 1, 2 and the pallets 321, 331 formed by the upper and lower joints plates 321, 331 of corner junction 3, therefore both surfaces can be used for signs or advertisements.

Figure 5:
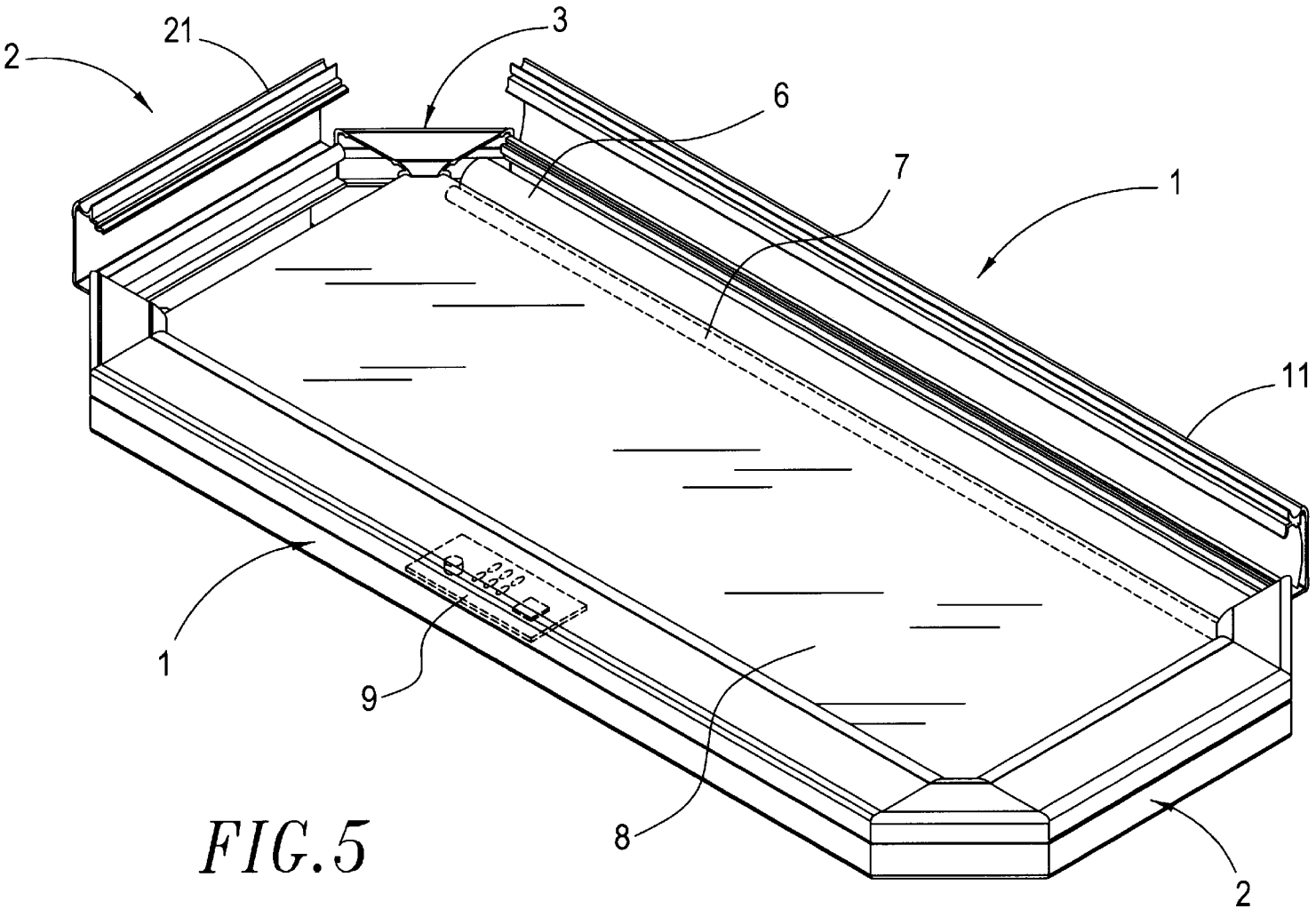
FIGS. 5 and 6 are the illustrative views which show how to dispose the accompanied component parts for the sign boards in the handy encasement according to the present invention.
Figure 6:
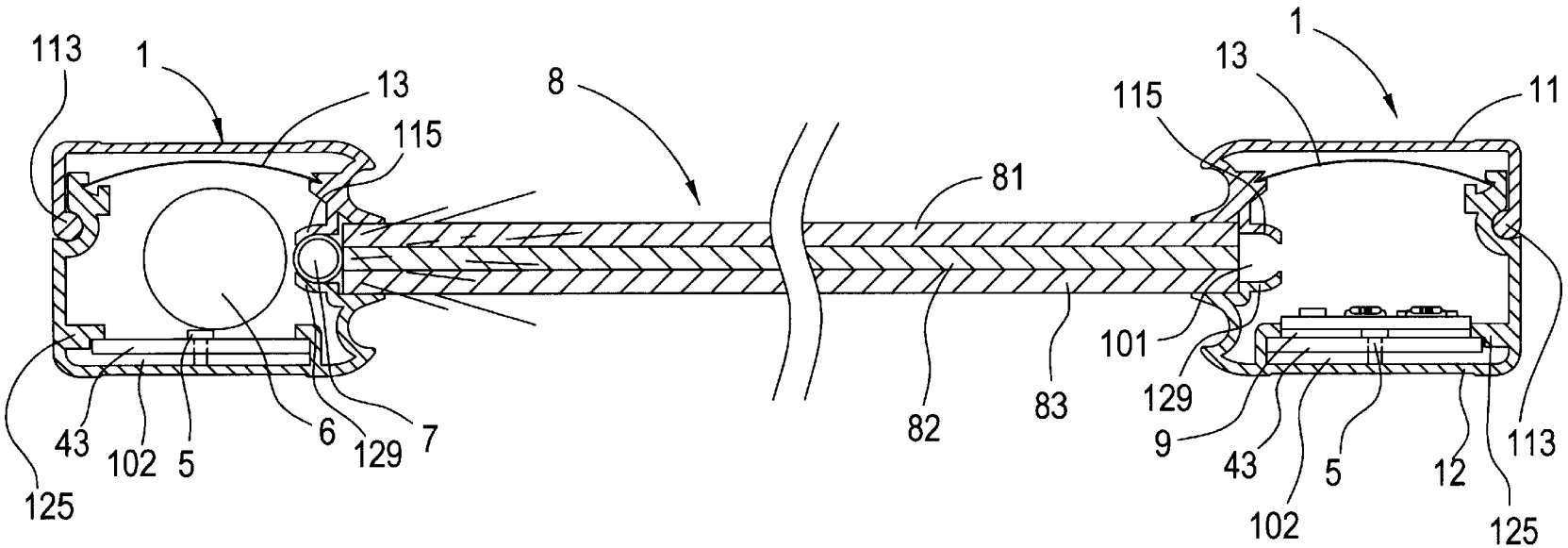

For understanding how to use the encasement of the present invention, reference should be made to FIGS. 5 and 6. A battery 6 may be set in the accommodation space 10 of the transverse skeleton 1, and a lamp 7 is equipped in the opening 101 formed by the arcuate plates 115, 129 of the base 12 and the upper lid 11 such that the battery 6 supplies power to the lamp 7 for lighting. A control circuit board 9 is disposed on the opposite transverse skeleton 1 and connected to the battery 6 and the lamp 7 via corner junctions 3 and the space along the longitudinal skeletons 2. The surface board 8 can be glazed in the rectangular slot formed along the inner edges of the encasement. The surface board 8 is constructed by stacking three pieces of flat component plates using the intermediate one as a light conducting plate 82, signs or advertisements may be printed or painted on the two outer plates 81, 83. The light emitted from the lamp 7 is conducted by the middle light conducting plate 82 to illuminate the advertisement object on the two outer plates 81, 83, The upper lids 11, 21 of the skeletons 1, 2 are opendable by inserting fingers into the recesses 114, 214 of the upper lids 11, 21 and the recesses 128, 227 of the bases 12, 22 without the need of any tools for replacement of components such as lamp 7, battery 6 and control circuit board 9 set inside the encasement, or changing content of advertisements on the surface boards 8.

It is understood form the above description that the encasement fabricated according to the present invention is noticeably superior to those fabricated according to conventional techniques because it has several advantages namely:

1. Simple construction makes it easy to assemble and detach by free hand without the need of any tools.

2. Two surface boards can be utilized for advertisement.

Those who are skilled in the art will readily perceive how to modify the invention. Therefore the appended claims are to be construed to cover all equivalent structures which fall within the true scope and spirit of the invention.

What is claimed is:

1. A handy encasement essentially comprising:

two transverse skeletons each of them further including a base and an upper lid, one end of said base is formed into a guide slot while the portion below said guide slot is curved to form a detent slot, the top portion of said base is formed into a recess with a pallet on it, and an arcuate plate is further extended inwardly from said pallet, a joint portion is formed in said base, one end of said upper lid is formed into a block while the other end thereof is formed into a second recess with a second pallet below it, said second pallet is further inwardly extended to form a second a arcuate plate, a notch is formed on the tip of said upper lid, when said upper lid is put on said base, said block formed on said upper lid falls into said detent slot formed on said base so as to form an accommodation space therebetween, a spring bow is then laid between said base and said upper lid with its one end slidably set in said guide slot of said base, while the other end thereof is inserted into said notch, said two arcuate plates respectively formed at the tips of said upper lid and said base do not come to touch with each other but forms an opening therebetween;

two longitudinal skeletons each of them also including a base and an upper lid, wherein one end of said base is formed into a detent slot, while the other end is formed into a recess which entrains a pallet on it, and an extension plate with a button is protruded upwardly form said pallet, and a joint portion is formed on said base, one end of said upper lid has another block, while the other end thereof is formed into a recess with a pallet below it, a hasp with a detent slot is extended from said pallet, with this structure the upper lid can be opened by the articulation motion of said block in said detent slot, when said upper lid is enclosed on said base, and said button is clogged in said detent slot, a closed space is formed in said longitudinal skeleton;

at least one corner junction, each having an upper and a lower triangular joint plates vertically extended from both ends of the main body of said corner junction thereof, said two corresponding joint plates form an space therebetween, each of said two joint plates has a pallet respectively at its own front tip;

at least one patch member, each having two flexed end plates extended from two sides of said patch member main body, and several tapped holes are provided on said end plates;

in assembling, firstly, setting said patch member main body on said lower joint plate of said corner junction, then respectively setting said end plates of said patch member in said joint portion of said transverse and said longitudinal skeletons and bolting with screws to tightly engage said base of said transverse skeletons, said corner junction, and said base of said longitudinal skeletons together thereby forming a rectangular parallelopiped framework, besides, a rectangular slot is formed along the inner edges of said framework by said pallets formed of said bases and said upper lids of the transverse and the longitudinal skeletons, and said pallets formed of said upper and said lower joint plates of the corner junctions such that a surface board can be provided on each of the two surfaces by glazing the plate into said slot.

2. The handy encasement of claim 1, wherein, when said upper lid of said transverse skeleton is lifted up , said spring bow interlaid between said base and said upper lid secures said two parts tightly from separating.

3. The handy encasement of claim 1, wherein, said recesses formed on said base and said upper lid of the transverse skeletons serve for the an operator to insert fingers when lifting up said upper lid.

4. The handy encasement of claim 1, wherein, said recesses formed on said base and said upper lid of the longitudinal skeletons serve for an operator to insert fingers when lifting up said upper lid.

5. The handy encasement of claim 1, wherein, said rectangular slot formed by said transverse and longitudinal skeletons, said corner junctions, and said patch members is for glazing a surface board for sign or advertisements.

6. The handy encasement of claim 1, wherein, four corner junctions are installed.

7. The handy encasement of claim 1, wherein, four patch members are installed.

8. The handy encasement of claim 1, wherein, a lamp is equipped in said open space formed at the front edge of said transverse skeletons.

9. The handy encasement of claim 1, wherein, a battery can be set in the accommodation space of said transverse skeletons.

10. The handy encasement of claim 1, wherein, said surface board is constructed by stacking three pieces of flat component plates using the middle one as a light conducting plate, signs or advertisements can be printed or painted on the two outer plates.

* * * * *